US010093871B2

(12) United States Patent
Koseoglu et al.

(10) Patent No.: US 10,093,871 B2
(45) **Date of Patent: *Oct. 9, 2018**

(54) DESULFURIZATION AND SULFONE REMOVAL USING A COKER

(71) Applicant: Saudi Arabian Oil Company, Dhahran (SA)

(72) Inventors: Omer Refa Koseoglu, Dhahran (SA); Abdennour Bourane, Dhahran (SA); Stephane Kressmann, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/437,271

(22) Filed: Feb. 20, 2017

(65) Prior Publication Data

US 2017/0158972 A1 Jun. 8, 2017

Related U.S. Application Data

(63) Continuation-in-part of application No. 12/876,781, filed on Sep. 7, 2010, now Pat. No. 9,574,143.

(51) Int. Cl.

| | |
|---|---|
| ***C10G 55/04*** | (2006.01) |
| ***C10G 21/16*** | (2006.01) |
| ***C10G 21/20*** | (2006.01) |

(52) U.S. Cl.

CPC ..... *C10G 55/04* (2013.01); *C10G 21/16* (2013.01); *C10G 21/20* (2013.01); *C10G 2300/202* (2013.01); *C10G 2300/44* (2013.01)

(58) Field of Classification Search

CPC ..... C10G 21/06; C10G 21/12; C10G 21/16; C10G 21/22; C10G 21/28;

(Continued)

(56) References Cited

U.S. PATENT DOCUMENTS

| | | | |
|---|---|---|---|
| 2,380,713 | A | 7/1945 | Wilson |
| 2,704,295 | A | 3/1955 | Gilbert et al. |

(Continued)

FOREIGN PATENT DOCUMENTS

| | | | |
|---|---|---|---|
| WO | 0218518 | A1 | 3/2002 |
| WO | 03014266 | A1 | 2/2003 |

(Continued)

OTHER PUBLICATIONS

Skov et al., "The ULSD oxidative desulfurization option", Hydrocarbon Engineering, 2007, pp. 1-5.

(Continued)

*Primary Examiner* — Renee Robinson
*Assistant Examiner* — Derek N Mueller
(74) *Attorney, Agent, or Firm* — Bracewell LLP; Constance Gail Rhebergen

(57) ABSTRACT

Embodiments provide a method and apparatus for upgrading a hydrocarbon feedstock. According to at least one embodiment, the method includes (a) supplying a hydrocarbon feedstock to an oxidation reactor, where the hydrocarbon feedstock is oxidized in the presence of a catalyst under conditions sufficient to selectively oxidize sulfur compounds present in the hydrocarbon feedstock; (b) separating the hydrocarbons and the oxidized sulfur compounds by solvent extraction; (c) collecting a residue stream that includes the oxidized sulfur compounds; (d) supplying the residue stream to a coker to produce coker gases and solid coke; and (e) supplying spent adsorbent including residual oils from the adsorption column to the coker for disposing the spent adsorbent after completion of an adsorption cycle.

21 Claims, 3 Drawing Sheets

(58) Field of Classification Search
CPC ..... C10G 2300/1074; C10G 2300/202; C10G 2300/44; C10G 25/003; C10G 27/04; C10G 27/12; C10G 53/04; C10G 53/08; C10G 53/14; C10G 55/00
See application file for complete search history.

(56) References Cited

U.S. PATENT DOCUMENTS

| | | | |
|---|---|---|---|
| 2,993,841 | A | 7/1961 | Sarno |
| 3,116,231 | A | 12/1963 | Adee |
| 3,379,638 | A | 4/1968 | Bloomer et al. |
| 3,472,761 | A | 10/1969 | Cameron |
| 3,563,884 | A | 2/1971 | Bloomer et al. |
| 4,036,736 | A | 7/1977 | Ozaki et al. |
| 4,177,133 | A | 12/1979 | Hayashi et al. |
| 4,216,074 | A | 8/1980 | Simone |
| 4,455,219 | A | 6/1984 | Janssen et al. |
| 4,481,101 | A | 11/1984 | Yan |
| 5,767,332 | A | 6/1998 | Vollmer et al. |
| 6,087,544 | A | 7/2000 | Wittenbrink et al. |
| 6,160,193 | A | 12/2000 | Gore |
| 6,277,271 | B1 | 8/2001 | Kocal |
| 7,001,502 | B1 | 2/2006 | Satchwell et al. |
| 7,232,516 | B2 | 6/2007 | Sughure, II et al. |
| 7,270,737 | B2 | 9/2007 | Picard et al. |
| 9,574,143 | B2 | 2/2017 | Bourane et al. |
| 2005/0150819 | A1 | 7/2005 | Wachs |
| 2005/0189261 | A1 | 9/2005 | Briot et al. |
| 2007/0051667 | A1 | 3/2007 | Martinie et al. |
| 2007/0102323 | A1 | 5/2007 | Lee et al. |
| 2007/0151901 | A1 | 7/2007 | Sain et al. |
| 2009/0148374 | A1 | 6/2009 | Choi |

FOREIGN PATENT DOCUMENTS

| | | | |
|---|---|---|---|
| WO | 2006071793 | A1 | 7/2006 |
| WO | 2007103440 | A2 | 9/2007 |

OTHER PUBLICATIONS

International Search Report and Written Opinion Issued in PCT Application PCT/US2011/050506, dated Nov. 10, 2011 (10 pages).

Parkash, "Residuum Processing", Refining Processes Handbook, 2003, pp. 176-189, Elevisier.

Zhang et al., "Fluid Catalytic Cracking Study of Coker Gas oil: Effects of Processing Parameters on Sulfur and Nitrogen Distributions", Energy Fuels, 2014, pp. 1362-1371, vol. 28, American Chemical Society.

DESULFURIZATION AND SULFONE REMOVAL USING A COKER

CROSS REFERENCE TO RELATED APPLICATION

This application is a continuation-in-part application of U.S. patent application Ser. No. 12/876,781 filed on Sep. 7, 2010, entitled "Desulfurization and Sulfone Removal Using A Coker," which will issue as U.S. Pat. No. 9,574,143, on Feb. 21, 2017, and is hereby incorporated by reference in its entirety into this application.

BACKGROUND

Field

Embodiments relate to a method and apparatus for desulfurizing a hydrocarbon feedstock. More specifically, embodiments relate to a method and apparatus for desulfurization of a hydrocarbon feedstock by oxidative desulfurization of the hydrocarbon feedstock and the subsequent treatment of oxidized sulfur- and nitrogen-containing species with a coker.

Description of the Related Art

Crude oil is the world's main source of hydrocarbons used as fuel and petrochemical feedstock. At the same time, petroleum and petroleum-based products are also a major source for air and water pollution today. To address growing concerns surrounding pollution caused by petroleum and petroleum-based products, many countries have implemented strict regulations on petroleum products, particularly on petroleum-refining operations and the allowable concentrations of specific pollutants in fuels, such as the allowable sulfur and nitrogen content in gasoline fuels. While the exact compositions of natural petroleum or crude oils vary significantly, all crude oils contain some measurable amount of sulfur compounds and most crude oils also contain some measurable amount of nitrogen compounds. In addition, crude oils may also contain oxygen, but the oxygen content of most crude is low. Generally, sulfur concentrations in crude oils are less than about 5 percent by weight (wt %), with most crude oils having sulfur concentrations in the range from about 0.5 to about 1.5 wt %. Nitrogen concentrations of most crude oils are usually less than 0.2 wt %, but can be as high as 1.6 wt %. In the United States, motor gasoline fuel is regulated to have a maximum total sulfur content of less than 10 parts per million weight (ppmw) sulfur.

Crude oils are refined in oil refineries to produce transportation fuels and petrochemical feedstocks. Typically, fuels for transportation are produced by processing and blending of distilled fractions from the crude oil to meet the particular end use specifications. Because most of the crudes generally available today have high concentrations of sulfur, the distilled fractions typically require desulfurization to yield products, which meet various performance specifications, environmental standards, or both.

The sulfur-containing organic compounds present in crude oils and resulting refined fuels can be a major source of environmental pollution. The sulfur compounds are typically converted to sulfur oxides during the combustion process, which in turn can produce sulfur oxyacids and contribute to particulate emissions.

One method for reducing particulate emissions includes the addition of various oxygenated fuel blending compounds, compounds that contain few or no carbon-to-carbon chemical bonds, such as methanol and dimethyl ether, or both. Most of these compounds, however, suffer in that they can have high vapor pressures, are nearly insoluble in diesel fuel, or have poor ignition quality, as indicated by their cetane numbers, or combinations thereof.

Diesel fuels that have been treated by chemical hydrotreating or hydrogenation to reduce their sulfur and aromatics contents can have a reduced fuel lubricity, which in turn can cause excessive wear of fuel pumps, injectors, and other moving parts that come in contact with the fuel under high pressures.

For example, middle distillates (that is, a distillate fraction that nominally boils in the range of about 180-370° C.) can be used as a fuel, or alternatively can be used as a blending component of fuel for use in compression ignition internal combustion engines (that is, diesel engines). The middle distillate fraction typically includes between about 1 and 3 wt % sulfur. Allowable sulfur concentration in middle distillate fractions were reduced to 5-50 ppmw levels from 3000 ppmw level since 1993 in Europe and United States.

Conventional techniques currently employed for the removal of sulfur and nitrogen compounds typically still require the subsequent recovery and/or disposal of the sulfur- and nitrogen-containing compounds that are removed from the hydrocarbons. In order to comply with the increasingly stringent regulations for ultra-low sulfur content fuels, refiners must make fuels having even lower sulfur levels at the refinery gate, so that they can meet the strict specifications after blending.

Low pressure conventional hydrodesulfurization (HDS) processes can be used to remove a major portion of the sulfur from petroleum distillates for the blending of refinery transportation fuels. These units, however, are not efficient to remove sulfur from compounds at mild conditions (that is, up to about 30 bar pressure), when the sulfur atom is sterically hindered as in multi-ring aromatic sulfur compounds. This is particularly true where the sulfur heteroatom is hindered by two alkyl groups (for example, 4,6-dimethyldibenzothiophene). Because of the difficulty in the removal, the hindered dibenzothiophenes predominate at low sulfur levels, such as 50 ppmw to 100 ppmw. Severe operating conditions (for example, high hydrogen partial pressure, high temperature, or high catalyst volume) must be utilized in order to remove the sulfur from these refractory sulfur compounds. Increasing the hydrogen partial pressure can only be achieved by increasing the recycle gas purity, or new grassroots units must be designed, which can be a very a costly option. The use of severe operating conditions typically results in decreased yield, lower catalyst life cycle, and product quality deterioration (for example, color), and therefore are typically sought to be avoided.

Conventional methods for petroleum upgrading, however, suffer from various limitations and drawbacks. For example, hydrogenative methods typically require large amounts of hydrogen gas to be supplied from an external source to attain desired upgrading and conversion. These methods can also suffer from premature or rapid deactivation of catalyst, as is typically the case during hydrotreatment of a heavy feedstock or hydrotreatment under harsh conditions, thus requiring regeneration of the catalyst or addition of new catalyst, which in turn can lead to process unit downtime. Thermal methods frequently suffer from the production of large amounts of coke as a byproduct and a limited ability to remove impurities, such as, sulfur and nitrogen. Additionally, thermal methods require specialized equipment suitable for severe conditions (for example, high temperature and high pressure), and require the input of significant energy, thereby resulting in increased complexity and cost.

Thus, there exists a need to provide a process for the desulfurization of a hydrocarbon feedstock, such as by the removal of sulfur and nitrogen from the hydrocarbon feedstocks, and which also includes steps for the desulfurization and denitrogenation of hydrocarbon feedstocks that use low severity conditions that can also provide means for the recovery and/or disposal of sulfur- and nitrogen-containing compounds, or both.

SUMMARY

Embodiments provide a method and apparatus for the upgrading of a hydrocarbon feedstock that removes a major portion of the sulfur and nitrogen present and in turn utilizes these compounds in an associated process.

According to at least one embodiment, there is provided a method of upgrading a hydrocarbon feedstock, including the steps of supplying the hydrocarbon feedstock to an oxidation reactor, the hydrocarbon feedstock including sulfur-containing compounds; and contacting the hydrocarbon feedstock with an oxidant in the presence of a catalyst in the oxidation reactor under conditions sufficient to selectively oxidize sulfur compounds present in the hydrocarbon feedstock to produce a hydrocarbon stream that includes hydrocarbons and oxidized sulfur-containing compounds. The method further includes supplying the hydrocarbon stream to an extraction vessel and separating the hydrocarbon stream into an extracted hydrocarbon stream and a mixed stream by extracting the hydrocarbon stream with a polar solvent, where the mixed stream includes the polar solvent and the oxidized sulfur-containing compounds and where the extracted hydrocarbon stream has a lower concentration of the sulfur containing-compounds than the hydrocarbon feedstock. Further, the method includes separating the mixed stream using a distillation column into a first recovered polar solvent stream and a first residue stream, supplying the first residue stream to a coker to produce a volatile component stream, and supplying spent adsorbent including residual oils from the adsorption column to the coker for disposing the spent adsorbent after completion of an adsorption cycle.

According to at least one embodiment, the method further includes supplying the extracted hydrocarbon stream to a stripper to produce a second recovered polar solvent stream and a stripped hydrocarbon stream, and recycling the first recovered polar solvent stream and the second polar solvent stream to an extraction vessel for the separating the hydrocarbons and the oxidized sulfur-containing compounds in the oxidized hydrocarbon stream.

According to at least one embodiment, the oxidant is selected from the group consisting of air, oxygen, oxides of nitrogen, peroxides, hydroperoxides, organic peracids, and combinations thereof.

According to at least one embodiment, the oxidation reactor catalyst is a metal oxide having the formula $M_xO_y$, wherein M is an element selected from Groups IVB, VB, and VIB of the periodic table.

According to at least one embodiment, the oxidation reactor is maintained at a temperature of between about 20 and 150° C. and at a pressure of between about 1-10 bars.

According to at least one embodiment, the ratio of the oxidant to sulfur compounds present in the hydrocarbon feedstock is between about 4:1 and 10:1.

According to at least one embodiment, the polar solvent has a Hildebrandt value of greater than about 19.

According to at least one embodiment, the polar solvent is selected from the group consisting of acetone, carbon disulfide, pyridine, dimethyl sulfoxide, n-propanol, ethanol, n-butanol, propylene glycol, ethylene glycol, dimethlyformamide, acetonitrile, methanol and combinations of the same.

According to at least one embodiment, the polar solvent is acetonitrile.

According to at least one embodiment, the polar solvent is methanol.

According to at least one embodiment, the solvent extraction is conducted at a temperature of between about 20° C. and 60° C. and at a pressure of between about 1-10 bars.

According to at least one embodiment, the hydrocarbon feedstock further includes nitrogen-containing compounds, such that the step of contacting the hydrocarbon feedstock with the oxidant in the presence the catalyst oxidizes at least a portion of the nitrogen-containing compounds, and wherein the residue stream supplied to the coker includes the oxidized nitrogen-containing compounds.

According to at least one embodiment, the method further includes supplying the extracted hydrocarbon stream to an adsorption column, where the adsorption column is charged with an adsorbent suitable for the removal of oxidized compounds present in the extracted hydrocarbon stream, and where the adsorption column produces a high purity hydrocarbon product stream and a second residue stream, the second residue stream containing a portion of the oxidized compounds.

According to at least one embodiment, the method further includes supplying the second residue stream to the coker.

According to at least one embodiment, the adsorbent is selected from the group consisting of activated carbon, silica gel, alumina, natural clays, and combinations of the same.

According to at least one embodiment, the adsorbent is a polymer coated support, where the support has a high surface area and is selected from the group consisting of silica gel, alumina, and activated carbon, and the polymer is selected from the group consisting of polysulfone, polyacrylonitrile, polystyrene, polyester terephthalate, polyurethane and combinations of the same.

According to at least one embodiment, the spent adsorbent stream is one of continuously or intermittently supplied to the coker.

According to at least one embodiment, the adsorbent includes one of a carbon-based adsorbent or a non-carbon based adsorbent.

According to at least one embodiment, when the adsorbent is the carbon-based adsorbent, the coker produces the volatile component stream with no ash.

According to at least one embodiment, when the adsorbent is the non-carbon-based adsorbent, the spent adsorbent acts as a slag material to cool reactor walls of the coker and the coker produces the volatile component stream with ash.

According to another embodiment, there is provided a method for upgrading a hydrocarbon feedstock including sulfur-containing compounds. The method for upgrading the hydrocarbon feedstock includes supplying the hydrocarbon feedstock having a boiling point of up to about 500° C. to reaction zone where the hydrocarbon feedstock is contacted with an oxidant in the presence of a catalyst to oxidize at least a portion of the sulfur-containing compounds in the hydrocarbon feedstock and produces an intermediate product stream including hydrocarbons and oxidized sulfur-containing compounds. The method further includes supplying the intermediate product stream including hydrocarbons and oxidized sulfur-containing compounds to an extraction vessel, where the intermediate product stream is contacted with a polar solvent, and where the polar solvent selectively extracts oxidized sulfur-containing compounds from the intermediate product stream, to produce a first hydrocarbon product stream including hydrocarbons and having a lower concentration of sulfur-containing compounds than the hydrocarbon feedstock and a mixed stream including the polar solvent and the extracted oxidized sulfur containing compounds. Further, the method includes separating the mixed stream by distillation to produce a recovered polar solvent stream including a major portion of the polar solvent, and a residue stream including the oxidized sulfur-containing compounds, and supplying the residue stream to a coker to produce a recovered hydrocarbon product stream including condensed coker vapors and gas oil and solid coke, where the coker includes a coker furnace and a coker drum, and where the coker furnace is operated at a temperature of at least about 400° C. and the coker drum is operated at a temperature of at least about 425° C. and a pressure in the range of between about 1 and 50 bars. The method further includes supplying spent adsorbent including residual oils from the adsorption column to the coker for disposing the spent adsorbent after completion of an adsorption cycle.

According to at least one embodiment, the method further includes recycling at least a portion of the recovered polar solvent stream to the extraction vessel, where at least a portion of the recovered polar solvent stream is combined with the polar solvent.

According to at least one embodiment, the step of oxidizing at least a portion of the sulfur-containing compounds in the hydrocarbon feedstock includes contacting the hydrocarbon feedstock with the oxidant and catalyst in the oxidation reaction, where the oxidation reactor is maintained at a temperature of between about 20° C. and 150° C. and a pressure of between about 1 and 20 bars for a contact time of between about 5 and 60 minutes.

According to at least one embodiment, the ratio of catalyst to oil is between about 0.1% and 10% by weight.

According to at least one embodiment, the polar solvent has a Hildebrandt solubility value of greater than about 19.

According to at least one embodiment, the extraction vessel is maintained at a temperature of between about 20° C. and 60° C.

According to at least one embodiment, the hydrocarbon feedstock further includes nitrogen-containing compounds, such that the step of supplying the hydrocarbon feedstock to be contacted with the oxidant in the presence the catalyst oxidizes at least a portion of the nitrogen-containing compounds, and where the residue stream supplied to the coker includes the oxidized nitrogen-containing compounds.

BRIEF DESCRIPTION OF THE DRAWINGS

So that the manner in which the features and advantages of the method and system disclosed, as well as others which will become apparent, may be understood in more detail, a more particular description of the method and system briefly summarized previously may be had by reference to the embodiments thereof which are illustrated in the appended drawings, which form a part of this specification. It is to be noted, however, that the drawings illustrate only various embodiments and are therefore not to be considered limiting of the scope as it may include other effective embodiments as well. Like numbers refer to like elements throughout, and the prime notation, if used, indicates similar elements in alternative embodiments or positions.

DETAILED DESCRIPTION

Although the following detailed description contains many specific details for purposes of illustration, it is understood that one of ordinary skill in the art will appreciate that many examples, variations and alterations to the following details are within the scope and spirit. Accordingly, the various embodiments described and provided in the appended figures are set forth without any loss of generality, and without imposing limitations, relating to the claims.

Embodiments address problems associated with conventional methods for upgrading a hydrocarbon feedstock, particularly methods for the desulfurization and denitrogenation of hydrocarbon feedstocks, and the subsequent recovery, removal, and disposal of sulfur- and nitrogen-containing compounds. In certain embodiments, embodiments find use of various sulfur- and nitrogen-containing compounds that are removed from the hydrocarbon feedstock. Thus, according to at least one embodiment, there is provided a method for the removal of sulfur from a hydrocarbon feedstock and the subsequent supply of the oxidized sulfur species to a delayed coker to produce gas oil and coke.

As used, the terms "upgrading" or "upgraded," with respect to petroleum or hydrocarbons refers to a petroleum or hydrocarbon product that is lighter (that is, has fewer carbon atoms, such as methane, ethane, and propane), has at least one of a higher API gravity, higher middle distillate yield, lower sulfur content, lower nitrogen content, or lower metal content, than does the original petroleum or hydrocarbon feedstock.

Figure 1:
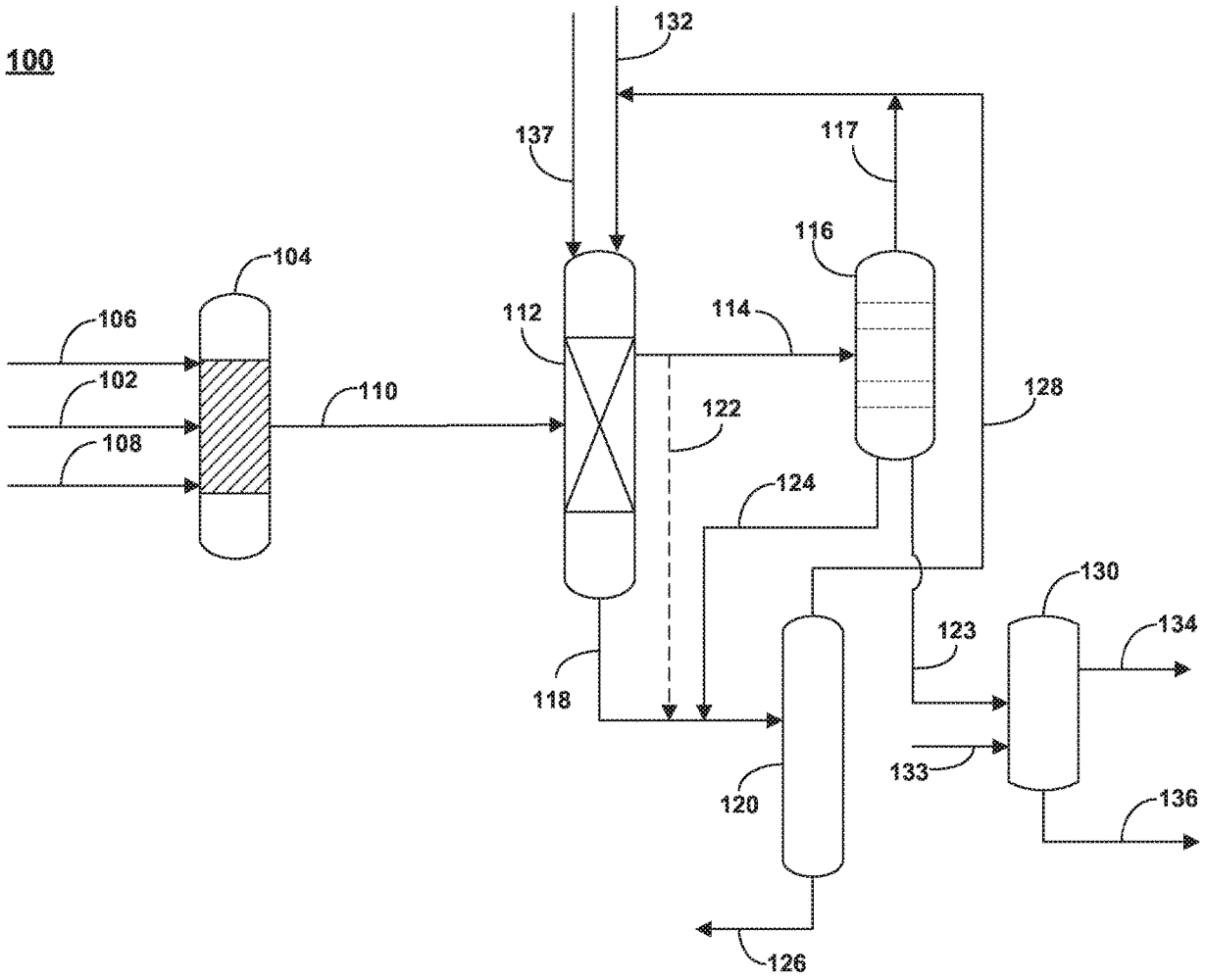
FIG. 1 provides a schematic diagram of an embodiment of the method of upgrading a hydrocarbon feedstock.

FIG. 1 provides an embodiment for the upgrading of hydrocarbons. Hydrocarbon upgrading system 100 includes oxidation reactor 104, extraction vessel 112, solvent regeneration column 116, stripper 120, and coker 130.

According to at least one embodiment, there is provided a method for the upgrading of a hydrocarbon feedstock, particularly a hydrocarbon feedstock that includes sulfur- or nitrogen-containing compounds, or both. The method includes supplying hydrocarbon feedstock 102 to oxidation reactor 104, where the hydrocarbon feedstock is contacted with an oxidant and a catalyst. Sulfur- and nitrogen-containing compounds are preferably oxidized upon contacting the oxidant and catalyst. The oxidant can be supplied to oxidation reactor 104 via oxidant feed line 106 and fresh catalyst can be supplied to the reactor via catalyst feed line 108.

According to at least one embodiment, hydrocarbon feedstock 102 can be any petroleum based hydrocarbon, and can include various impurities, such as elemental sulfur, compounds that include sulfur or nitrogen, or both. In certain embodiments, hydrocarbon feedstock 102 can be a diesel oil having a boiling point between about 150° C. and about 400° C. Alternatively, hydrocarbon feedstock 102 can have a boiling point up to about 450° C., alternatively up to about 500° C. In certain embodiments, hydrocarbon feedstock 102 can be a diesel oil having a boiling point between about 150° C. and 370° C. In certain embodiments, hydrocarbon feedstock 102 can be a vacuum gas oil having a boiling point between about 370° C. and 520° C. Alternatively, hydrocarbon feedstock 102 can have a boiling point up to about 450° C., alternatively up to about 500° C. Alternatively, hydrocarbon feedstock 102 can have a boiling point between about 100° C. and 500° C. Optionally, hydrocarbon feedstock 102 can have a boiling point up to about 600° C., alternatively up to about 700° C., or, in certain embodiments, greater than about 700° C. In certain embodiments, hydrocarbon feedstock 102 can include heavy hydrocarbons. Heavy hydrocarbons refers to hydrocarbons having a boiling point of greater than about 360° C., and can include aromatic hydrocarbons, as well as alkanes, alkenes, and naphthenes, as non-limiting examples.

Generally, in certain embodiments, hydrocarbon feedstock 102 can be selected from whole range crude oil, topped crude oil, product streams from oil refineries, product streams from refinery steam cracking processes, liquefied coals, liquid products recovered from oil or tar sand, bitumen, oil shale, asphaltene, and the like, and mixtures thereof.

Sulfur compounds present in hydrocarbon feedstock 102 can include sulfides, disulfides, and mercaptans, as well as aromatic molecules such as thiophenes, benzothiophenes, dibenzothiophenes, and alkyl dibenzothiophenes, such as 4,6-dimethyl-dibenzothiophene. Aromatic compounds are typically more abundant in higher boiling fractions, than is typically found in the lower boiling fractions.

Nitrogen-containing compounds present in hydrocarbon feedstock 102 can include basic and neutral nitrogen compounds, including indoles, carbazoles, anilines, quinolines, acridines, and the like, and mixtures thereof.

According to at least one embodiment, oxidation reactor 104 can be operated at mild conditions, relative to the conditions typically used in conventional hydrodesulfurization processes for diesel type feedstocks. More specifically, in certain embodiments, oxidation reactor 104 can be maintained at a temperature of between about 20° C. and about 150° C., alternatively between about 30° C. and about 150° C., alternatively between about 30° C. and about 90° C., or between about 90° C. and about 150° C. In certain embodiments, the temperature is preferably between about 30° C. and about 75° C., more preferably between about 45° C. and 60° C. The operating pressure of oxidation reactor 104 can be between about 1 and 80 bars, alternatively between about 1 and 30 bars, alternatively between about 1 and 15 bars, and preferably between about 2 and 3 bars. The residence time of the hydrocarbon feedstock within oxidation rector 102 can be between about 1 and 180 minutes, alternatively between about 15 and 180 minutes, alternatively between about 15 and 90 minutes, alternatively between about 5 and 60 minutes, alternatively between about 60 and 120 minutes, alternatively between about 120 and 180 minutes, and is preferably for a sufficient amount of time for the oxidation of any sulfur- or nitrogen-compounds present in the hydrocarbon feedstock. In one embodiment, the residence time of the hydrocarbon feedstock within oxidation rector 104 is between about 15 and 45 minutes. For comparison, conventional hydrodesulfurization of diesel-type feedstocks is typically conducted under harsher conditions, for example, at temperatures of between about 330 and 380° C., pressures of between about 50 and 80 bars, and liquid hourly space velocity (LHSV) of between about 0.5 and 2 $h^{-1}$.

According to at least one embodiment, oxidation reactor 104 can be any reactor suitably configured to ensure sufficient contacting between hydrocarbon feedstock 102 and the oxidant, in the presence of a catalyst, for the oxidation of the sulfur- and nitrogen-containing compounds. Suitable reactors for oxidation reactor 104 can include, for example, batch reactors, fixed bed reactors, ebullated bed reactors, lifted reactors, fluidized bed reactors, slurry bed reactors, and the like. Sulfur and nitrogen compounds present in hydrocarbon feedstock 102 are oxidized in oxidation reactor 104 to sulfones, sulfoxides, and oxidized nitrogen compounds, which can be subsequently removed by extraction or adsorption. Oxidized nitrogen compounds can include, for example, pyridine and pyrrole-based compounds or pyridine-difuran compounds. Frequently, during oxidation, the nitrogen atom itself is not oxidized, but rather the compound is oxidized to a compound that is easy to separate from the remaining compounds.

According to at least one embodiment, the oxidant is supplied to oxidation reactor 104 via oxidant feed stream 106. Suitable oxidants can include air, oxygen, hydrogen peroxide, organic peroxides, hydroperoxides, organic peracids, peroxo acids, oxides of nitrogen, ozone, and the like, and combinations thereof. Peroxides can be selected from hydrogen peroxide and the like. Hydroperoxides can be selected from t-butyl hydroperoxide and the like. Organic peracids can be selected from peracetic acid and the like.

In certain embodiments, such as hydrocarbon feedstocks having a greater concentration of sulfur than nitrogen, the mole ratio of oxidant to sulfur present in the hydrocarbon feedstock can be from about 1:1 to 50:1, preferably between about 2:1 and 20:1, more preferably between about 4:1 and 10:1.

In certain other embodiments, such as hydrocarbon feedstocks having a greater concentration of nitrogen than sulfur, for example, certain South American crude oils, certain African crude oils, certain Russian crude oils, certain Chinese crude oils, and certain intermediate refinery streams like coker, thermal cracking, visbreaking, FCC cycle oils, and the like, the mole ratio of oxidant to nitrogen present in the hydrocarbon feedstock can be from about 1:1 to 50:1, preferably between about 2:1 and 20:1, more preferably between about 4:1 and 10:1.

According to at least one embodiment, the catalyst can be supplied to oxidation reactor 104 via catalyst feed stream 108. The catalyst can be a homogeneous catalyst. The catalyst can include at least one metal oxide having the chemical formula $M_xO_y$, wherein M is a metal selected from groups IVB, VB, or VIB of the periodic table. Metals can include titanium, vanadium, chromium, molybdenum, and tungsten. Molybdenum and tungsten are two particularly effective catalysts that can be used in various embodiments. In certain embodiments, the spent catalyst can be rejected from the system with the aqueous phase (for example, when using an aqueous oxidant) after the oxidation vessel.

According to at least one embodiment, the ratio of catalyst to oil is between about 0.1% by weight and about 10% by weight, preferably between about 0.5% by weight and about 5% by weight. In certain embodiments, the ratio is between about 0.5% by weight and about 2.5% by weight. Alternatively, the ratio is between about 2.5% by weight and about 5% by weight. Other suitable weight ratios of catalyst to oil will be apparent to those of skill in the art and are to be considered within the scope of the various embodiments.

Catalyst present in oxidation reactor 104 can increase the rate of oxidation of the various sulfur- and nitrogen-containing compounds in hydrocarbon feedstock 102, thereby achieving completion of the reaction and oxidation of sulfur- and nitrogen-containing compounds in a shorter amount of time, and reducing the amount of oxidant necessary to achieve oxidation of the sulfur- and nitrogen-containing compounds. In certain embodiments, the catalyst may have increased selectivity toward the oxidation of sulfur-containing or nitrogen-containing species, or both. In other embodiments, the catalyst is selective to the minimization of oxidation of aromatic hydrocarbons.

According to at least one embodiment, oxidation reactor 104 produces oxidized sulfur- and oxidized nitrogen-containing hydrocarbon stream 110, which can include oxidized sulfur- and oxidized nitrogen-containing hydrocarbon species. The oxidation by-products vary based upon the original oxidant. For example, in embodiments wherein the oxidant is hydrogen peroxide, water is formed as a by-product of the oxidation reaction. In embodiments where the oxidant is an organic peroxide, alcohol is formed as a by-product of the oxidation reaction. By-products are typically removed during the extraction and solvent recovery steps.

Oxidized sulfur- and oxidized nitrogen-containing hydrocarbon stream 110 is supplied to extraction vessel 112 where the oxidized sulfur- and oxidized nitrogen-containing hydrocarbon species are contacted with extraction solvent stream 137. Extraction solvent 137 can be a polar solvent, and in certain embodiments, can have a Hildebrandt solubility value of greater than about 19. In certain embodiments, when selecting the particular polar solvent for use in extracting oxidized sulfur- and oxidized nitrogen-containing species, selection can be based upon, in part, solvent density, boiling point, freezing point, viscosity, and surface tension, as non-limiting examples. Polar solvents suitable for use in the extraction step can include acetone (Hildebrand value of 19.7), carbon disulfide (20.5), pyridine (21.7), dimethyl sulfoxide (DMSO) (26.4), n-propanol (24.9), ethanol (26.2), n-butyl alcohol (28.7), propylene glycol (30.7), ethylene glycol (34.9), dimethylformamide (DMF) (24.7), acetonitrile (30), methanol (29.7), and like compositions or compositions having similar physical and chemical properties. In certain embodiments, acetonitrile and methanol, due to their low cost, volatility, and polarity, are preferred. Methanol is a particularly suitable solvent for use in embodiments. In certain embodiments, solvents that include sulfur, nitrogen, or phosphorous, preferably have a relatively high volatility to ensure adequate stripping of the solvent from the hydrocarbon feedstock.

According to at least one embodiment, the extraction solvent is non-acidic and the extraction step is conducted in an acid-free environment. The use of acids is typically avoided due to the general corrosive nature of acids, and the requirement that all equipment be specifically designed for a corrosive environment. In addition, acids, such as acetic acid, can present difficulties in separation due to the formation of emulsions.

According to at least one embodiment, extraction vessel 112 can be operated at a temperature of between about 20° C. and about 60° C., preferably between about 25° C. and about 45° C., even more preferably between about 25° C. and about 35° C. Extraction vessel 112 can operate at a pressure of between about 1 and 10 bars, preferably between about 1 and 5 bars, more preferably between about 1 and 2 bars. In certain embodiments, extraction vessel 112 operates at a pressure of between about 2 and 6 bars.

According to at least one embodiment, the ratio of the extraction solvent to hydrocarbon feedstock can be between about 1:3 and 3:1, preferably between about 1:2 and 2:1, more preferably about 1:1. Contact time between the extraction solvent and the oxidized sulfur and oxidized nitrogen containing hydrocarbon stream 110 can be between about 1 second and 60 minutes, preferably between about 1 second and about 10 minutes. In certain embodiments, the contact time between the extraction solvent and oxidized sulfur and oxidized nitrogen containing hydrocarbon stream 110 is less than about 15 minutes. In certain embodiments, extraction vessel 112 can include various means for increasing the contact time between the extraction solvent and oxidized sulfur- and oxidized nitrogen-containing hydrocarbon stream 110, or for increasing the degree of mixing of the two solvents. Means for mixing can include mechanical stirrers or agitators, trays, or like means.

According to at least one embodiment, extraction vessel 112 produces mixed stream 114 that can include extraction solvent, oxidized species (for example, the oxidized sulfur and nitrogen containing hydrocarbon species that were originally present in hydrocarbon feedstock 102), and the hydrocarbon feedstock, and extracted hydrocarbon stream 118, which can include the hydrocarbon feedstock having a reduced concentration of sulfur- and nitrogen-containing hydrocarbons, relative to hydrocarbon feedstock 102. Typically, the hydrocarbon feedstock is only present in mixed stream 114 in trace amounts.

Mixed stream 114 can be supplied to solvent regeneration column 116 where extraction solvent can be recovered as first recovered solvent stream 117 and separated from first residue stream 123, which includes oxidized sulfur- and nitrogen-containing hydrocarbon compounds. Optionally, mixed stream 114 can be separated in solvent regeneration column 116 into a recovered hydrocarbon stream 124, which can include hydrocarbons present in mixed stream 114 from hydrocarbon feedstock 102. Solvent regeneration column 116 can be a distillation column that is configured to separate mixed stream 114 into first recovered solvent stream 117, first residue stream 123, and recovered hydrocarbon stream 124.

Extracted hydrocarbon stream 118 can be supplied to stripper 120, which can be a distillation column or like vessel designed to separate a hydrocarbon product stream from residual extraction solvent. In certain embodiments, a portion of mixed stream 114 can optionally be supplied to stripper 120 via line 122, and where it can be combined with extracted hydrocarbon stream 118. In certain embodiments, solvent regeneration column 116 can produce recovered hydrocarbon stream 124, which can be supplied to stripper 120, where the recovered hydrocarbon stream can optionally be contacted with extracted hydrocarbon stream 118 or a portion of mixed stream 114, which can be supplied to stripper 120 via line 122.

Stripper 120 separates the various received streams into stripped oil stream 126, which includes hydrocarbons present in hydrocarbon feedstock 102 and has a reduced sulfur and nitrogen content relative to hydrocarbon feedstock 102, and second recovered solvent stream 128.

In certain embodiments, first recovered solvent stream 117 can be combined with second recovered solvent stream 128 and recycled to extraction vessel 112. Optionally, make-up solvent stream 132, which can include fresh solvent, can be combined with first recovered solvent stream 117, second recovered solvent stream 128, or both, and supplied to extraction vessel 112.

First residue stream 123, which includes oxidized sulfur- and nitrogen-containing compounds, and which can also include low concentrations of hydrocarbonaceous material, can be supplied to coker 130 where first residue stream 123 can be converted to recover hydrocarbons. Coker 130 can be a delayed coker, fluid coker, flexicoker, or like device. In certain embodiments, coker 130 can be a delayed coker. Delayed coker 130 can include at least a coker fractionator, a coker furnace, and at least one coke drum. In an embodiment, coker 130 is supplied with additional feedstock from alternate processes in addition to first residue stream 123.

In a basic delayed coking process that may be utilized in certain embodiments, the feed to coker 130 can include oxidized sulfur, oxidized nitrogen compounds, or both, as well as possibly also including trace amounts of extraction solvent, hydrocarbon feedstock 102, or both, and can be introduced into the lower part of a coker fractionator (not shown). Materials supplied to the coker fractionator, including the oxidized sulfur- or nitrogen-containing compounds, or both, can also include fractionator bottoms that can include heavy recycle material. Optionally, second hydrocarbon feedstock 133, which can include residual oils from a vacuum distillation column or atmospheric distillation column, can be supplied to coker 130.

Material supplied to coker 130 is heated to coking temperature in a coker furnace (not shown) to produce a heated coker feedstock. In certain embodiments, the coker furnace can be operated at a temperature greater than about 400° C., alternatively greater than about 450° C., alternatively greater than about 475° C. In certain embodiments, the coker furnace can be operated at a temperature between about 475° C. and 525° C.

According to at least one embodiment, the heated coker feedstock can then be supplied to a coke drum that is maintained at a temperature and pressure sufficient for coking conditions to decompose or crack the heated coker feedstock to form volatile component stream 134, which may include low molecular weight hydrocarbon gases. In certain embodiments, volatile component stream 134 can be collected and combined with stripped oil stream 126. In certain embodiments, volatile component stream 134 can be separately collected and utilized in an alternate process.

According to at least one embodiment, the coke drum can be operated at a temperature of greater than about 425° C., alternatively between about 425° C. and 650° C., alternatively between about 450° C. and 510° C., alternatively between about 470° C. and 500° C. In certain embodiments, the coker drum is operated at a temperature of at least 500° C., alternatively at a temperature of at least 525° C.

Operating pressures within the coker drum can be in the range of about 1-50 bars, alternatively in the range of about 5-40 bars, or alternatively in the range of about 10-30 bars. In certain embodiments, coker 130 is operated at a pressure in the range of about 10-25 bars. In alternate embodiments, coker 130 is operated at a pressure in the range of about 25-40 bars. In an alternate embodiment, coker 130 is operated at a pressure in the range of between about 1-10 bars, preferably between about 1-3 bars.

Volatile components (coker vapor) collected overhead as volatile component stream 134 from the coker drum can be recovered from the drum and returned to the coker fractionator. Light and heavy gas oil fractions from the coker fractionator can be supplied to a flash zone of the coker fractionator, where the heavy gas oil can be used to condense the heaviest components from the coker vapors. The heaviest fraction of the coke drum vapors can also be condensed by other techniques, such as with a heat exchange, but in certain embodiments, incoming coke drum vapors are preferably condensed with a light or heavy gas oil in the coker fractionator. In certain embodiments, a conventional heavy fraction recycle to the coker fractionator can include hydrocarbons condensed from the coke drum vapors and unflashed heavy gas oil. During the continuous process of feed, coke accumulates in the coker drum, such that when the coke drum is full of coke, the feed can be switched to another drum, and the full drum is cooled and emptied by conventional methods to produce coke stream 136, thereby allowing the process to operate continuously.

In certain embodiments, coker 130 includes two or more coker drums, which can be operated in an alternating fashion, as described above. For example, a feedstock can be supplied to a first coker drum, and the feedstock can be heated in the first coker drum to produce coker vapor and solid coke. After a predetermined amount of solid coke has accumulated within the first coker drum, the feedstock to the first coker drum can be stopped and can be supplied to a second coker drum, which is operated in a similar manner to the first drum, until a predetermined amount of coke has accumulated within the second coker drum. During the operation of the second coker drum, the feed and heating supply to the first coker drum can be stopped, and coke within the first coker drum can be removed. As noted above, by alternating between use of the first and second coker drums, it is possible to remove a drum from service, while not stopping the overall coking process. When a coker drum is removed from service, coke therein can be removed by conventional means to produce coke product stream 136.

Figure 2:
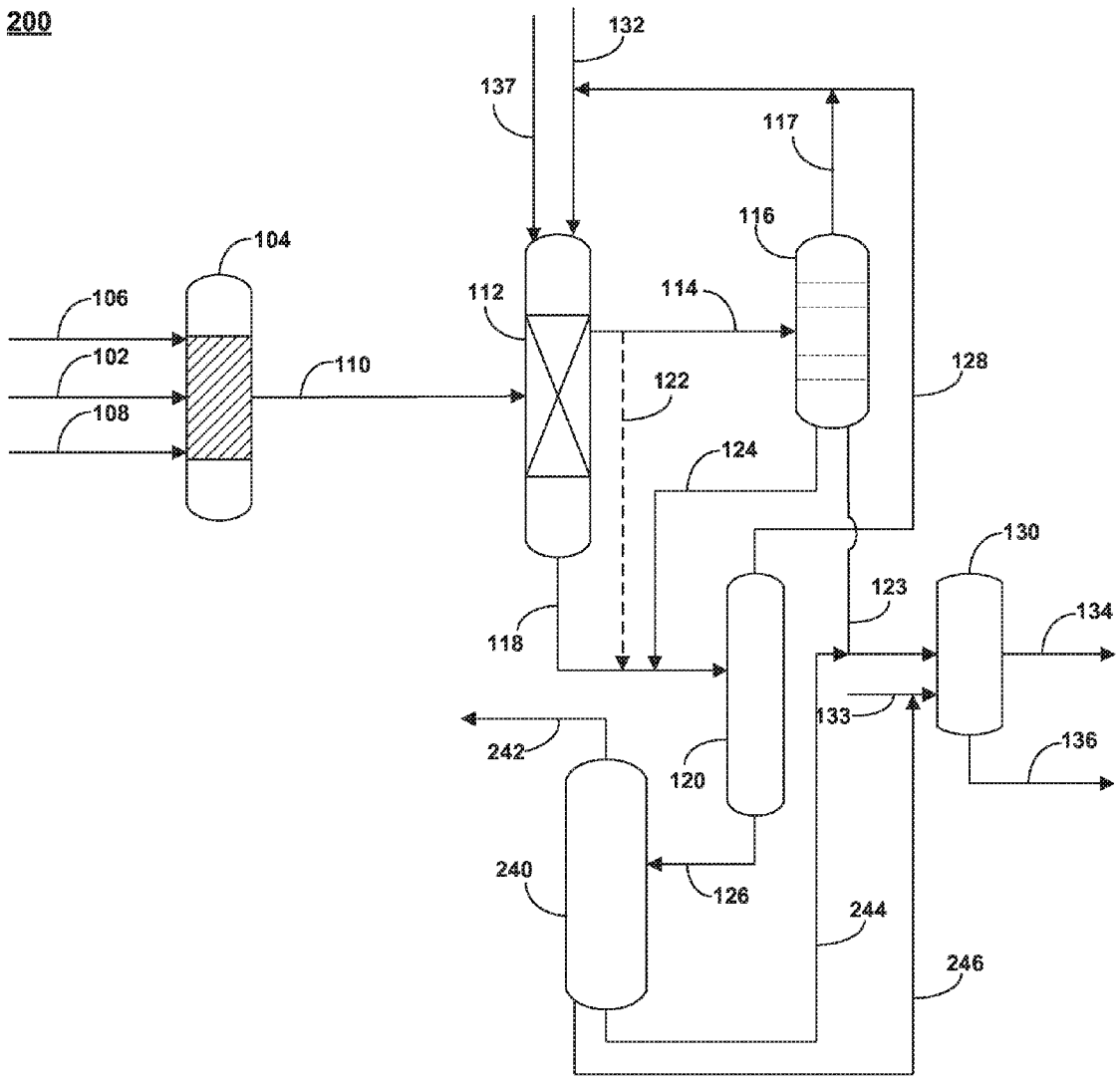
FIG. 2 provides a schematic diagram of an embodiment of the method of upgrading a hydrocarbon feedstock.

Referring to FIG. 2, a second embodiment if provided wherein stripped oil stream 126 can be supplied to an adsorption column 240, where stripped oil stream 126 can be contacted with one or more adsorbents designed to remove one or more of various impurities, such as sulfur-containing compounds, oxidized sulfur compounds, nitrogen-containing compounds, oxidized nitrogen compounds, and metals remaining in the hydrocarbon product stream after oxidation and solvent extraction steps, to produce hydrocarbon product stream 242 and adsorption unit residue stream 244.

According at least one embodiment, adsorbents can include activated carbon, silica gel, alumina, natural clays, and other inorganic adsorbents. In certain embodiments, the adsorbent can include polar polymers that have been applied to or that coat various high surface area support materials, such as silica gel, alumina, and activated carbon. Example polar polymers for use in coating various support materials can include polysulfones, polyacrylonitrile, polystyrene, polyester terephthalate, polyurethane, other like polymer species that exhibit an affinity for oxidized sulfur species, and combinations thereof.

According to at least one embodiment, adsorption column 240 can be operated at a temperature of between about 20° C. and about 60° C., preferably between about 25° C. and about 40° C., even more preferably between about 25° C. and about 35° C. In certain embodiments, the adsorption column can be operated at a temperature of between about 10° C. and about 40° C., alternatively between about 35° C. and about 75° C. In certain embodiments, adsorption column 240 can be operated at temperatures of greater than about 20° C., or alternatively at temperatures less than about 60° C. Adsorption column 240 can be operated at a pressure of up to about 15 bars, preferably up to about 10 bars, even more preferably between about 1 and about 2 bars. In certain embodiments, adsorption column 240 can be operated at a pressure of between about 2 and about 5 bars. In an exemplary embodiment, adsorption column 240 can be operated at a temperature of between about 25° C. and about 35° C. and a pressure of between about 1 and about 2 bars.

According to at least one embodiment, adsorption column 240 separates the feed into extracted hydrocarbon product stream 242 having very low sulfur content (for example, less than 15 ppmw of sulfur) and very low nitrogen content (for example, less than 10 ppmw of nitrogen), and second residue stream 244. Adsorption second residue stream 244 can include oxidized sulfur and oxidized nitrogen compounds, and can optionally be combined with first residue stream 123 and supplied to coker 130 and processed as discussed above.

According to another embodiment, as shown in FIG. 2, the adsorbent can be disposed of in coker 130, after it completes its cycle. As further shown in FIG. 2, a stream of spent adsorbent containing residual oil is supplied via line 246 from adsorption column 240 to the coking step in coker 130. The stream of spent adsorbent can be converted to valuable products. The stream of spent adsorbent may be supplied via line 246 in a continuous or intermittent manner.

According to at least one embodiment, the stream of spent adsorbent containing sulfones is fed to coker 130. In this embodiment, the adsorbent is an activated carbon with a pore volume of 0.429 cubic centimeters per gram (cc/g) and surface area of 820.5 square meters per gram ($m^2/g$). Adsorption column 240 operates in a continuous basis and the amount of adsorbent is calculated from the sulfones to be adsorbed. Adsorption column 240 can be designed to operate in a two-year cycle. The amount of activated carbon adsorbent is calculated to be 109 metric ton (MT) per two years. The amount of spent activated adsorbent fed to coker 130 is based on the daily equivalent of the total adsorbent, (so 109 MT/cycle*1 cycle/2 years*1 year/333 days basis). The conditions of coker 130 remain the same. The amount of adsorbent is calculated based on 5 kilograms per hour (Kg/h) sulfone fed to the adsorption step. In this example, adsorption column 240 is used as a polishing step to remove the small amount of sulfones left in the stream after the extraction. The adsorbent from adsorption column 240 will be collected and fed to coker 130. The addition rate depends upon the operations. The total amount may be divided to the number of cycle days and added daily, or the adsorbent is added at the maximum rate the delayed coker is designed. Assuming it is the daily amount, the adsorbed added is 6.9 Kg/h or 165 kg/day. According to one example, these addition rates provide the material balance shown in Table 1:

TABLE 1

Material Balance

| | Stream No. | | | |
|---|---|---|---|---|
| Component | 123 Kg/h | 132 Kg/h | 134 Kg/h | 136 Kg/h |
| Vacuum Residue | | 1,000.00 | | |
| Sulfones | 107.60 | | | |
| Adsorbent | 6.90 | | | |
| Light Coker Products | | | 668.60 | |
| Coke | | | | 440.90 |
| Total | 114.50 | 1,000.00 | 668.60 | 440.90 |

The sulfur removal process efficiency for both extraction vessel 112 and adsorption column 240 can be balanced or readjusted. In the given example, 98.96 wt % of the sulfones were removed in the extraction step and the remaining portion is removed in the adsorption step. The unit can be designed to remove sulfones at 50 wt % in the extraction and adsorption unit. In this case, there will be more adsorbent needed to separate the sulfones. At 50 wt % sulfur removal rate in the adsorption step, the amount of adsorbent needed is 5,224 MT. At this rate, more adsorbent will be fed to coker 130. The balance between the extraction and adsorption steps can be adjusted based on the design of the unit for a given battery limit conditions.

According to various embodiments, the adsorbent can include carbon-based adsorbents. The carbon-based adsorbents together with the adsorbed residual oil and the contaminants can be sent to coker 130 to produce volatile component 134 with no ash produced. In accordance with one embodiment, the carbon-based adsorbent can be used in one cycle and sent to coker 130 without any solvent regeneration of the adsorbent in the adsorption step. If the adsorbent is carbon-based, such as activated carbon, there will be no significant quality impact on the delayed coker coke.

According to various embodiments, the adsorbent can include a solid, non-carbon-based adsorbent, which acts as slag material to cool reactor walls of coker 130, particularly in the membrane wall and end up as ash. The adsorbed residual oil and the contaminants can be sent to coker 130 to produce volatile component stream 134. Examples of the non-carbon-based adsorbent include, for example, silica-alumina, alumina, titania, zeolites, refinery spent catalysts, and natural clays. If the adsorbent is not carbon-based, the quality of coke will be impacted. It will increase the ash content of the coke, so the targeted quality may not be obtained. The amount to be processed depends on the quality of coke produced. There are three types of delayed coker cokes: 1) fuel grade (shot) coke, 2) anode grade coke (sponge), and 3) electrode grade coke (needle). Table 2 shows the properties of these types of coke. The petroleum green coke recovered from the coking drums produces these coker cokes after the calcination, which is a thermal treatment to remove moisture and reduce the volatile combustible matter.

TABLE 2

Coker Coke Properties

| Property | Units | Fuel Coke | Calcined Sponge Coke | Calcined Needle Coke |
|---|---|---|---|---|
| Bulk Density | $Kg/m^3$ | 880.00 | 720.00-800.00 | 670.00-720.00 |
| Sulfur | wt % (max) | 3.50-7.50 | 1.00-3.50 | 0.20-0.50 |
| Nitrogen | ppmw (max) | 6,000.00 | — | 50.00 |
| Nickel | ppmw (max) | 500.00 | 200.00 | 7.00 |
| Vanadium | ppmw | 150.00 | 350.00 | — |
| Volatile Combustible Material | W % (max) | 12.00 | 0.50 | 0.50 |
| Ash Content | wt % (max) | 0.35 | 0.40 | 0.10 |
| Moisture Content | wt % (max) | 8.00-12.00 | 0.30 | 0.10 |
| Hardgrove Grindability Index (HGI) | wt % | 35.00-70.00 | 60.00-100.00 | |

Figure 3:
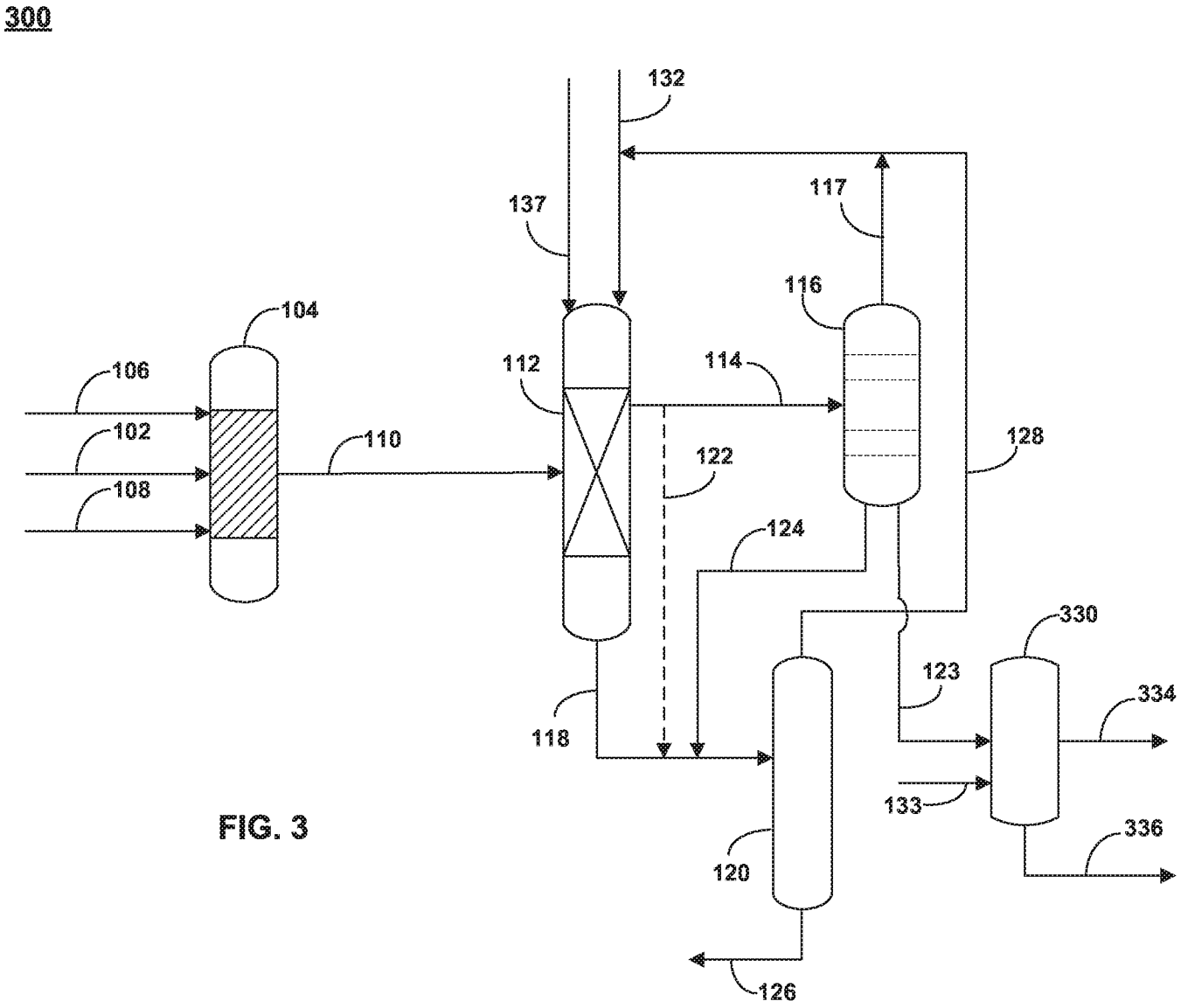
FIG. 3 provides a schematic diagram of one embodiment of the method of upgrading a hydrocarbon feedstock.

Referring to FIG. 3, a third embodiment is provided where first residue stream 123, which includes oxidized sulfur-containing compounds, oxidized nitrogen-containing compounds, or both, is supplied to thermal cracking unit 330. Thermal cracking unit 330 includes a series of tubes, which are heated to partially convert the feedstock to lower boiling fractions of hydrocarbons 334. Residue can be collected from thermal cracking unit 330 via line 336. In certain embodiments, thermal cracking unit 330 can be supplied with hydrocarbons from an alternate source via line 133. In certain embodiments, effluent from thermal cracking unit 330, which consists of lower boiling fractions of hydrocarbons, can be routed to the flash zone of stripper 120 (not shown).

EXAMPLES

In one example, a hydrotreated straight run diesel stream 102 containing 500 ppmw of elemental sulfur 0.28 wt % of organic sulfur density of 0.85 kilogram per liter (Kg/l) was oxidatively desulfurized. The oxidized and extracted sulfur compounds are mixed with residue stream feed stream 136, properties of which are shown in Table 3, and the combined stream was supplied to coker 130.

TABLE 3

| Property | Value |
|---|---|
| API Gravity | 4.60 |
| Specific Gravity | 1.04 |
| Sulfur Content, wt. % | 5.42 |
| Nitrogen Content, wt. % | 0.44 |
| Oxygen Content, wt. % | 0.10 |
| CCR, wt. % | 24.60 |
| $C_5$ - Asphaltenes, wt. % | 23.50 |
| Nickel, ppmw | 44.00 |
| Vanadium, ppmw | 162.00 |

The reaction conditions were as follows: the mole ratio of hydrogen peroxide to sulfur was 4:1. The catalyst was a Molybdenum (VI)-based catalyst. The reaction time was 30 minutes. The temperature was maintained at about 80° C., and the pressure was maintained at about 1 bar. The coker was operated at a temperature of about 482° C. and a pressure of about 1 bar. Material balances for the oxidation step are provided in Table 4.

TABLE 4

Material Balance

| | Stream No. | | | |
|---|---|---|---|---|
| Component | 102 Kg/h | 106 Kg/h | 108 Kg/h | 110 Kg/h |
| Water | 0.70 | 3.85 | 3.85 | 0.48 |
| Diesel | 1,099.93 | | | 1094.00 |
| Acetic Acid | | 150.00 | 150.00 | 95.00 |
| Hydrogen Peroxide | | 1.65 | 1.65 | |
| Solid Catalyst | | 1.50 | 1.50 | |
| Total | 1,100.63 | 157.00 | 157.00 | 1,189.48 |

Material balances for the extraction step for an embodiment are provided in Table 5.

TABLE 5

Material Balance

| | Stream No. | | | | | |
|---|---|---|---|---|---|---|
| Component | 110 Kg/h | 132 Kg/h | 114 Kg/h | 118 Kg/h | 117 Kg/h | 123 Kg/h |
| Water | 2.38 | | 0.42 | 0.60 | 0.42 | |
| MeOH | | 1,190.00 | 1,182.00 | 8.00 | 1182.00 | |
| Diesel | 5,472.63 | | | 967.00 | | |
| Diesel Reject | | | 102.60 | | | 102.60 |
| Acetic Acid | | | 95.00 | | 95.00 | |
| Solid Catalyst | | | | | | |
| Total | 5,475.01 | 1,190.00 | 1,380.02 | 975.60 | 1,277.42 | 102.60 |

Material balances for the coker step for an embodiment are provided in Table 6.

TABLE 6

Material Balance

| | Stream No. | | | |
|---|---|---|---|---|
| Component | 123 Kg/h | 132 Kg/h | 334 Kg/h | 336 Kg/h |
| Vacuum Residue | | 1,000.00 | | |
| Sulfones | 102.60 | | | |
| Light Coker Products | | | 668.62 | |
| Coke | | | | 433.98 |
| Total | 102.60 | 1,000.00 | 668.62 | 433.98 |

Yields for processing the feed with a coker are shown in Table 7.

TABLE 7

Coker Yields.

| Coker Yield | Percent Composition | MBP | SG | S, wt. % | N, ppm |
|---|---|---|---|---|---|
| Coke | 39.36 | | | 7.96 | 5,813.00 |
| Gas | 11.34 | | | | |
| $H_2S$ | 1.70 | | | | |
| $C_1$-$C_4$ | 9.64 | | | | |
| $C_1$ | 3.75 | | | | |
| $C_2$ | 2.10 | | | | |
| $C_3$ | 2.14 | | | | |
| $C_4$ | 0.59 | | | | |
| i-$C_4$ | 0.25 | | | | |
| n-$C_4$ | 0.66 | | | | |
| $H_2$ | 0.12 | | | | |
| $CO_2$ | 0.04 | | | | |
| Naphtha (BP 36-180° C.) | 19.73 | 108.00 | 0.74 | 1.78 | 67.00 |
| Light Coker Gas Oil (BP 180-350° C.) | 16.89 | 265.00 | 0.88 | 3.69 | 1,440.00 |
| Heavy Coker Gas Oil (BP 350-540° C.) | 12.68 | 445.00 | 0.98 | 5.98 | 2,833.00 |
| Total Liquid Products (Naphtha + LGCO + HGCO) | 49.30 | | | 3.51 | 1,248.80 |

It is believed that the methods and systems described herein will increase the amount of liquid hydrocarbons from aromatic sulfur, nitrogen compounds, and aromatic streams by linking an oxidative desulfurization and denitrogenation process with a coking unit or a thermal cracking unit. Furthermore, it is believed that there are not any efficient methods for disposing of the oxidation reaction byproducts (that is, the oxidized sulfur and nitrogen compounds).

Embodiments provide a way of disposing of the oxidized sulfur and nitrogen compounds without having to dispose of the compounds.

Although the various embodiments have been described in detail, it should be understood that various changes, substitutions, and alterations can be made hereupon without departing from the principle and scope. Accordingly, the scope should be determined by the following claims and their appropriate legal equivalents.

The singular forms "a," "an," and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed as from about one particular value to about another particular value. When such a range is expressed, it is to be understood that another embodiment is from the one particular value or to the other particular value, along with all combinations within said range.

That which is claimed is:

1. A method of upgrading a hydrocarbon feedstock, the method comprising:

supplying the hydrocarbon feedstock to an oxidation reactor, the hydrocarbon feedstock comprising sulfur-containing compounds;

contacting the hydrocarbon feedstock with an oxidant in the presence of a catalyst in the oxidation reactor under conditions sufficient to selectively oxidize sulfur compounds present in the hydrocarbon feedstock to produce a hydrocarbon stream that comprises hydrocarbons and oxidized sulfur-containing compounds;

supplying the hydrocarbon stream to an extraction vessel and separating the hydrocarbon stream into an extracted hydrocarbon stream and a mixed stream by extracting the hydrocarbon stream with a non-acidic polar organic solvent, the mixed stream comprising the non-acidic polar organic solvent and the oxidized sulfur-containing compounds and wherein the extracted hydrocarbon stream has a lower concentration of the sulfur containing-compounds than the hydrocarbon feedstock;

separating the mixed stream using a distillation column into a first recovered non-acidic polar organic solvent stream and a first residue stream;

supplying the first residue stream to a coker to produce a volatile component stream;

supplying the extracted hydrocarbon stream to a stripper to produce a second recovered non-acidic polar organic solvent stream and a stripped hydrocarbon stream;

recycling the first recovered non-acidic polar organic solvent stream and the second non-acidic polar organic solvent stream to an extraction vessel for the separating the hydrocarbons and the oxidized sulfur-containing compounds in the oxidized hydrocarbon stream;

supplying the stripped hydrocarbon stream to an adsorption column, the adsorption column being charged with an adsorbent suitable for the removal of oxidized compounds present in the stripped hydrocarbon stream, the adsorption column producing a high purity hydrocarbon product stream and a second residue stream, the second residue stream containing a portion of the oxidized compounds; and supplying spent adsorbent comprising residual oils from the adsorption column to the coker for disposing the spent adsorbent after completion of an adsorption cycle.

2. The method of claim 1, wherein the oxidant is selected from the group consisting of air, oxygen, oxides of nitrogen, peroxides, hydroperoxides, organic peracids, and combinations thereof.

3. The method of claim 1, wherein the oxidation reactor catalyst is a metal oxide having the formula $M_xO_y$, wherein M is an element selected from Groups IVB, VB, and VIB of the periodic table.

4. The method of claim 1, wherein the oxidation reactor is maintained at a temperature of between about 20 and 150° C. and at a pressure of between about 1-10 bars.

5. The method of claim 1, wherein the ratio of the oxidant to sulfur compounds present in the hydrocarbon feedstock is between about 4:1 and 10:1.

6. The method of claim 1, wherein the non-acidic polar organic solvent has a Hildebrandt value of greater than about 19.

7. The method of claim 1, wherein the solvent extraction is conducted at a temperature of between about 20° C. and 60° C. and at a pressure of between about 1-10 bars.

8. The method of claim 1, wherein the hydrocarbon feedstock further comprises nitrogen-containing compounds, such that the step of contacting the hydrocarbon feedstock with the oxidant in the presence the catalyst oxidizes at least a portion of the nitrogen-containing compounds, and wherein the residue stream supplied to the coker includes the oxidized nitrogen-containing compounds.

9. The method of claim 1, further comprising:

supplying the second residue stream to the coker.

10. The method of claim 1, wherein the adsorbent is selected from the group consisting of activated carbon, silica gel, alumina, natural clays, and combinations of the same.

11. The method of claim 10, wherein the adsorbent is a polymer coated support, wherein the support has a and is selected from the group consisting of silica gel, alumina, and activated carbon, and the polymer is selected from the group consisting of polysulfone, polyacrylonitrile, polystyrene, polyester terephthalate, polyurethane and combinations of the same.

12. The method of claim 1, wherein the spent adsorbent stream is one of continuously or intermittently supplied to the coker.

13. The method of claim 1, wherein the adsorbent comprises one of a carbon-based adsorbent or a non-carbon based adsorbent.

14. The method of claim 13, wherein, when the adsorbent is the carbon-based adsorbent, the coker produces the volatile component stream with no ash.

15. The method of claim 13, wherein, when the adsorbent is the non-carbon-based adsorbent, the spent adsorbent acts as a slag material to cool reactor walls of the coker and the coker produces the volatile component stream with ash.

16. A method for upgrading a hydrocarbon feedstock comprising sulfur-containing compounds, the method for upgrading the hydrocarbon feedstock comprising:

supplying the hydrocarbon feedstock having a boiling point of up to about 500° C. to reaction zone where the hydrocarbon feedstock is contacted with an oxidant in the presence of a catalyst to oxidize at least a portion of the sulfur-containing compounds in the hydrocarbon feedstock and produce an intermediate product stream comprising hydrocarbons and oxidized sulfur-containing compounds;

supplying the intermediate product stream comprising hydrocarbons and oxidized sulfur-containing compounds to an extraction vessel, wherein the intermediate product stream is contacted with a non-acidic polar organic solvent, the non-acidic polar organic solvent being dimethylformamide, wherein the non-acidic polar organic solvent selectively extracts oxidized sulfur-containing compounds from the intermediate product stream, to produce a first hydrocarbon product stream comprising hydrocarbons and having a lower concentration of sulfur-containing compounds than the hydrocarbon feedstock and a mixed stream comprising the non-acidic polar organic solvent and the extracted oxidized sulfur containing compounds;

separating the mixed stream by distillation to produce a recovered non-acidic polar organic solvent stream comprising a major portion of the non-acidic polar organic solvent, and a residue stream comprising the oxidized sulfur-containing compounds;

supplying the residue stream to a coker to produce a recovered hydrocarbon product stream comprising condensed coker vapors and gas oil and solid coke, wherein the coker includes a coker furnace and a coker drum, and wherein the coker furnace is operated at a temperature of at least about 400° C. and the coker drum is operated at a temperature of at least about 425° C. and a pressure in the range of between about 1 and 50 bars;

supplying the extracted oxidized sulfur containing compounds to an adsorption column, the adsorption column being charged with an adsorbent suitable for the removal of oxidized compounds present in the extracted hydrocarbon stream, the adsorption column producing a high purity hydrocarbon product stream and a second residue stream, the second residue stream containing a portion of the oxidized compounds;

supplying spent adsorbent comprising residual oils from the adsorption column to the coker for disposing the spent adsorbent after completion of an adsorption cycle; and recycling at least a portion of the recovered non-acidic polar organic solvent stream to the extraction vessel, wherein at least a portion of the recovered non-acidic polar organic solvent stream is combined with the non-acidic polar organic solvent.

17. The method of claim 16, wherein the step of oxidizing at least a portion of the sulfur-containing compounds in the hydrocarbon feedstock comprises contacting the hydrocarbon feedstock with the oxidant and catalyst in the oxidation reaction, wherein the oxidation reactor is maintained at a temperature of between about 20° C. and 150° C. and a pressure of between about 1 and 20 bars for a contact time of between about 5 and 60 minutes.

18. The method of claim 17, wherein the ratio of catalyst to oil is between about 0.1% and 10% by weight.

19. The method of claim 16, wherein the non-acidic polar organic solvent has a Hildebrandt solubility value of greater than about 19.

20. The method of claim 16, wherein the extraction vessel is maintained at a temperature of between about 20° C. and 60° C.

21. The method of claim 16, wherein the hydrocarbon feedstock further comprises nitrogen-containing compounds, such that the step of supplying the hydrocarbon feedstock to be contacted with the oxidant in the presence the catalyst oxidizes at least a portion of the nitrogen-containing compounds, and wherein the residue stream supplied to the coker includes the oxidized nitrogen-containing compounds.

* * * * *